US005237773A

United States Patent [19]

Claridge

[11] Patent Number: 5,237,773

[45] Date of Patent: Aug. 24, 1993

[54] INTEGRAL LASER SIGHT, SWITCH FOR A GUN

[75] Inventor: Joseph M. Claridge, Northridge, Calif.

[73] Assignee: Claridge Hi-Tec Inc., Northridge, Calif.

[21] Appl. No.: 763,024

[22] Filed: Sep. 20, 1991

[51] Int. Cl.[5] ..... F41G 1/35

[52] U.S. Cl. ..... 42/103; 362/113; 362/114

[58] Field of Search ..... 42/103, 100; 362/110, 362/113, 114

[56] References Cited

U.S. PATENT DOCUMENTS

| | | | |
|---|---|---|---|
| 1,045,800 | 11/1912 | Lewis | 362/114 |
| 1,201,052 | 10/1916 | Jakubyansky | 42/103 |
| 1,215,171 | 3/1917 | Lewis | 42/103 |
| 1,338,239 | 4/1920 | Matys | 362/114 |
| 1,993,979 | 3/1935 | Reed | 42/103 |
| 2,085,732 | 7/1937 | Barter et al. | 42/103 |
| 2,093,514 | 9/1937 | Cornett et al. | 362/114 |
| 2,550,694 | 5/1951 | Hazen et al. | 42/100 |
| 3,739,167 | 6/1973 | Avery | 42/103 |
| 4,168,588 | 9/1979 | Snyder | 42/103 |
| 4,856,218 | 8/1989 | Reynolds, Jr. | 42/103 |
| 4,934,086 | 6/1990 | Houde-Walter | 42/103 |
| 5,064,988 | 11/1991 | E'nama et al. | 42/103 |

FOREIGN PATENT DOCUMENTS

| | | | |
|---|---|---|---|
| 977351 | 3/1951 | France | 362/110 |

OTHER PUBLICATIONS

Taurus International, The Taurus/Laser Aim Package, Mar., 1990, lone page, Shooting Times.

Webster, Webster's Ninth New Collegiate Dictionary, 1985, p. 628.

*Primary Examiner*—Stephen M. Johnson

*Attorney, Agent, or Firm*—Lyon & Lyon

[57] ABSTRACT

A gun capable of shooting projectiles and having a barrel and a handle, comprising a laser mounted under the barrel and a switch for operating the laser mounted on the back of the handle.

2 Claims, 4 Drawing Sheets

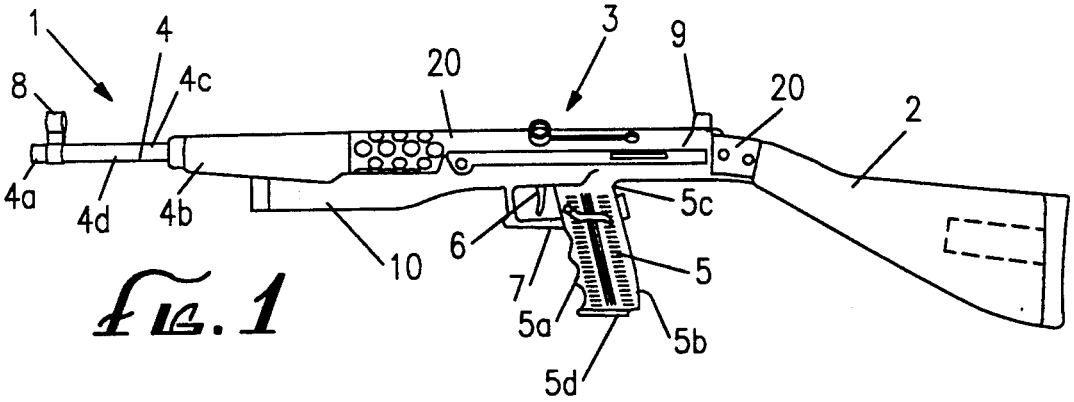
FIG. 1
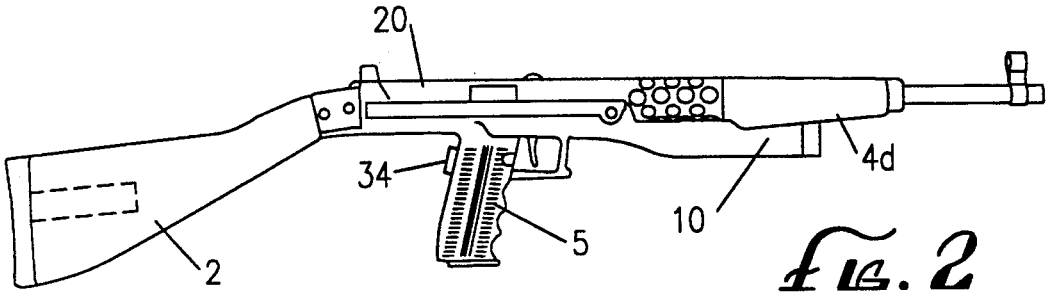
FIG. 2
FIG. 3
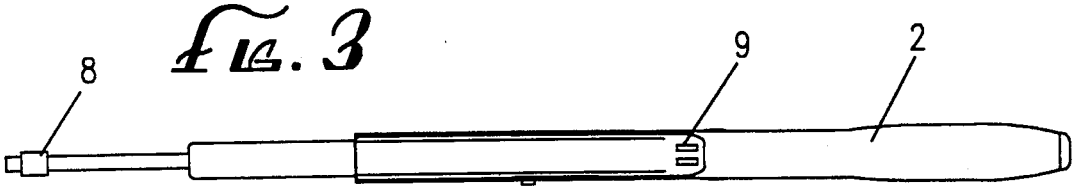
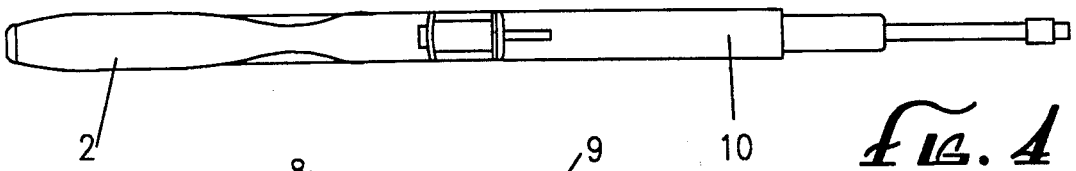
FIG. 4
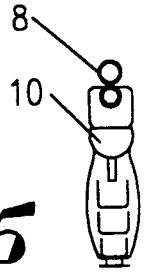
FIG. 5
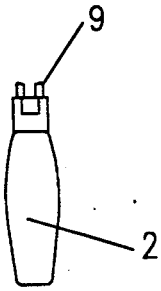
FIG. 6

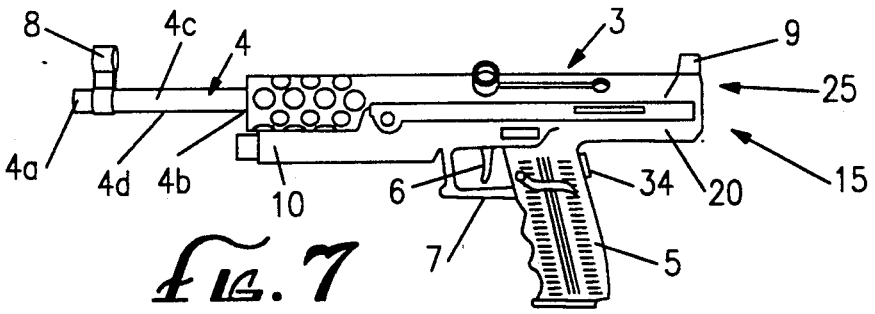
FIG. 7
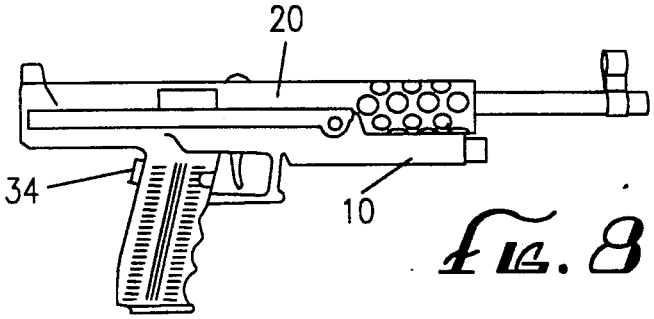
FIG. 8
FIG. 9
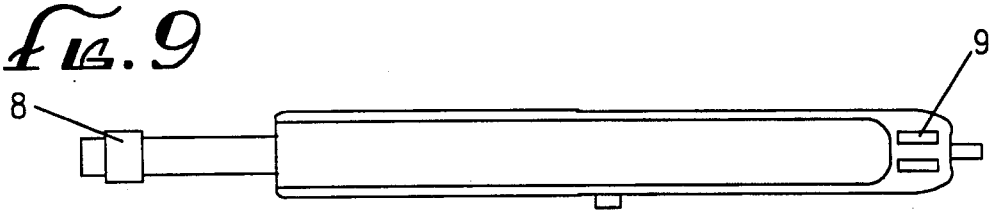
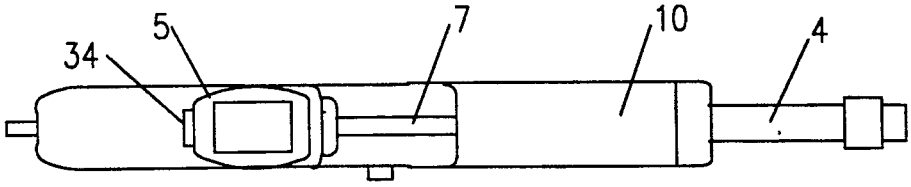
FIG. 10
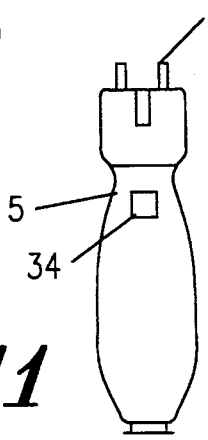
FIG. 11
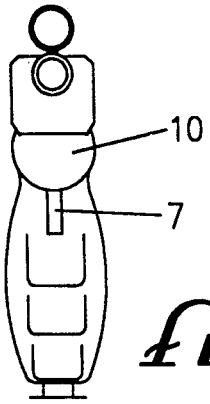
FIG. 12

INTEGRAL LASER SIGHT, SWITCH FOR A GUN

BACKGROUND OF THE INVENTION

The present invention relates to the field of guns.

The path taken by the bullet shot from a gun is determined primarily by the direction in which the barrel of the gun is aimed. Traditionally, aiming a gun was done by aligning the barrel sights. Recently, telescopic sights have been used to replace or augment the barrel sights. More recently still, lasers have been used to replace or augment other types of sights. Laser sights have now been used on many different types of guns, including pistols and carbines.

In laser sighting, a battery powered laser may be mounted on a gun, and may be operated by means of a switch. The laser emits a beam of coherent visual light which indicates the direction in which the barrel of the gun is aimed. By observing the reflection of the laser beam, a user can modify his or her aim. Of course, depending on many factors including the projectile being used, the thrust imparted to the projectile, the distance to the target, wind, and altitude, it may be desirable to aim the gun at an appropriate offset from the target rather than at the target itself. Regardless of where the gun is aimed, laser sighting offers numerous advantages, including the ability to aim a gun more rapidly and more accurately than with other sighting systems, and the ability to aim a gun accurately while holding it in a non-standard position, such as when firing from the hip or on the run.

One of the problems encountered in prior hand-held guns using lasers is that placement of the laser on the gun may obstruct standard sighting or adversely affect operation of the gun. For example, placement of the laser on top of the barrel may make it impossible or impractical to use other barrel sighting means in the event of a failure of the laser or of a decision not to use the laser. Placement of the laser to the side of the barrel may imbalance the gun either by the weight or the bulk of the laser. Moreover, nonintegral lasers mounted on top of the barrel were awkward and cumbersome.

Another problem encountered in using lasers to sight hand-held guns is that placement of the laser switch on the gun may adversely affect operation of the gun.

SUMMARY OF THE INVENTION

The present invention is directed to the placement of a laser on a gun and a switch used to operate the laser. In one aspect of the present invention, the laser is integrally mounted below the barrel rather than on the top or to the side of the barrel. Below-barrel placement of the laser permits use of additional barrel sighting systems such as a telescopic sight. This is an advantage in the event that it is impossible or undesirable to operate the laser. Also, use with a telescopic sight may enhance the value of the laser sight. Below-barrel placement of the laser also eliminates any side-to-side unbalancing effects of the laser. Thus, the advantages of the present invention relating to laser location, are that the laser does not preclude the use of other sighting systems, and does not imbalance or adversely affect the operation of the gun. In the preferred embodiment of the present invention, the laser switch is mounted on the back of the handle such that it can be momentarily operated by the thumb of the trigger hand. The advantage of this present invention is that laser operation does not interfere with operation of the gun, and the laser sight is still convenient to operate.

BRIEF DESCRIPTION OF THE DRAWINGS

These and other objects and advantages of the present invention will become better understood through a consideration of the following description taken in conjunction with the drawings in which:

FIGS. 1 and 2 are side views of a carbine or rifle having a laser sight mounted under the barrel and a switch mounted on the handle.

FIGS. 3 and 4 are top views of a carbine or rifle and

FIGS. 5 and 6 are front and back views of the same carbine.

FIGS. 7 and 8 are side views of a pistol having a laser sight mounted under the barrel and a switch mounted on the handle.

FIGS. 9 and 10 are top and bottom views of a pistol and

FIGS. 11 and 12 are front and back views of the same pistol.

DETAILED DESCRIPTION OF THE PREFERRED EMBODIMENT

Figure 13:
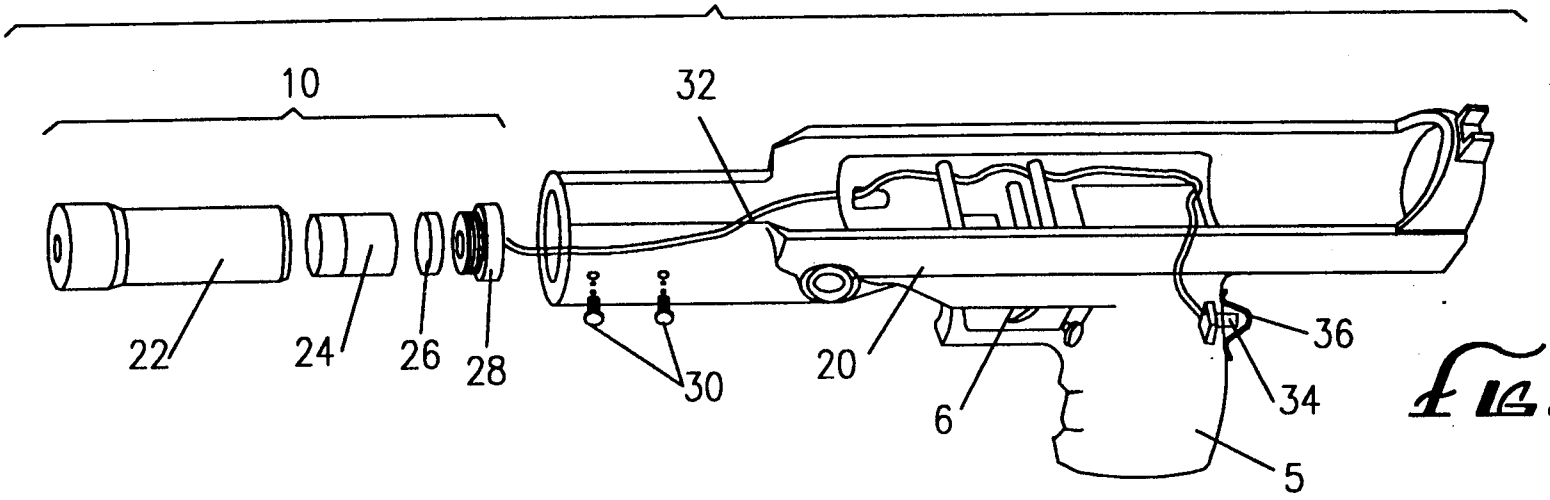
FIGS. 13, 14, 15 and 16 are partial cutaways of a portion of the carbine (or rifle) or pistol which contains the laser.
Figure 14:
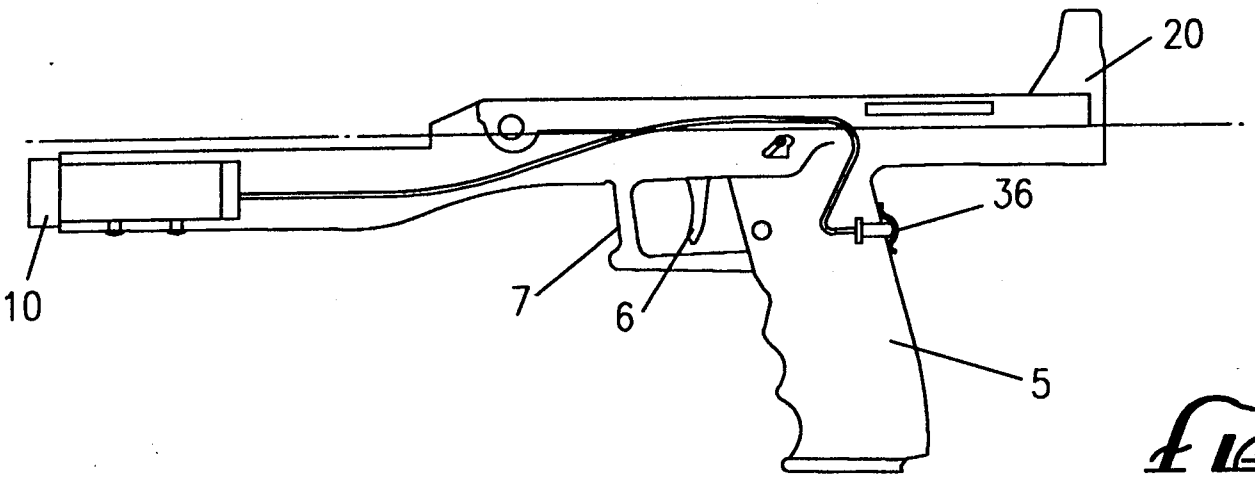

As shown in FIG. 13 and 14, integral housing 20 forms an upwardly receiving portion 21 for receiving the chamber 3 and barrel 4. Also shown in those Figures as well as FIGS. 7 and 8, the receiving portion of the housing 21 extends rearwardlly and has a socket-like or receptacle-shaped portion 23 for receiving the rear portion of said chamber and barrel assembly (3 and 4). As stated previously and as shown in FIGS. 1-14, the housing has an integrally cast laser enclosure.

Turning now to the drawings, in FIG. 1, a carbine or rifle 1 is comprised generally of a stock 2, a chamber 3, a barrel 4, a handle or pistol grip 5, a trigger 6, and a trigger guard 7. These are built integrally with a housing 20. The barrel 4 has a front **4*a* and a back 4*b*, a top 4*c* and a bottom 4*d*. The handle or pistol grip 5 has a front 5*a*, a back 5*b*, a top 5*c* and a bottom 5*d*. Visual sights 8, 9 are mounted on the top 4*c* of the barrel 4 and housing 20 adjacent to the connection of the stock. As shown principally in FIGS. 13 and 14, laser assembly 10 is mounted integrally on the housing 20 and below barrel 4. In the presently preferred embodiment, laser assembly 10 is shown forward of and juxtaposing the trigger guard 7. However, it will be apparent to those skilled in the art that many different types and configurations of lasers may be used. Laser assembly 10 is comprised of laser 22, typically powered by a 7.0 V battery 24. Contact 26 and end cap 28 complete the assembly with the end cap having threads for engaging mating threads on the tubular container for the laser assembly. The laser assembly 10 is affixed to the housing 20 via bolts 30. Wires 32 connect the laser to switch 34. It will also be apparent that the laser assembly 10 need not be mounted in exactly the same position as shown. It is within the spirit and scope of this invention for the laser 10 to be mounted at any position integrally under the barrel, including placement more towards the front 4*a* of the barrel 4, and also in a position under the barrel 4 in which the laser 10 does not physically touch the barrel 4**.

Switch 34 is positioned on the back of the pistol grip or handle 5. In the presently preferred embodiment, the switch 34 is positioned such that it can be momentarily operated by squeezing the web between the thumb and forefinger of the user's trigger hand against the handle 5. Positioning and operating the switch 34 in this manner permits the user to momentarily activate the laser, aim the carbine 1, and pull the trigger 6 without using a second hand. The switch 34 can also be positioned towards the bottom 5*b* of the pistol grip or handle, where that it could be operated by the butt of the user's trigger hand (not shown). It is anticipated that the switch 34 will be operated while the handle 5 is being gripped in a manner normally used for firing the carbine or pistol.

It is important to note that the integral laser and housing assembly shown in FIGS. 13 and 14 can also be used in a pistol.

Figure 16:
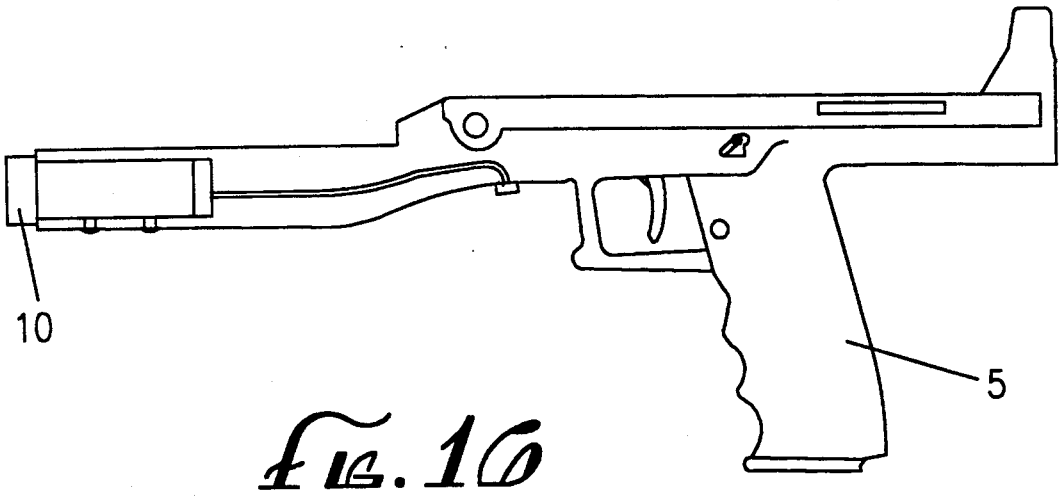

FIGS. 7 and 8 for example show a pistol 15 which also has a chamber 3, a barrel 4, a handle 5 or pistol grip, a trigger 6, and a trigger guard 7. The barrel 4 has a front 4*a*, a back 4*b*, a top 4*c* and a bottom 4*d*. Visual sights 8,9 are mounted on the top 4*c* of the housing 20 which holds barrel 4, and a laser 10 is mounted on the bottom 4*d* of the barrel 4 integral with the housing. The laser assembly 10 of the pistol 15 is mounted somewhat more anterior relative to the overall length of the barrel 4 than is shown in FIG. 1, but of course the relative position of the laser assembly 10 to the overall barrel 4 may be affected by the length of the barrel. It is within the spirit and scope of the present invention for the switch 34 to operate according to other principles, such as a toggle (not shown), as long as the switch is positioned on the handle 5 as described above. There are two other embodiments contemplated by the present invention. The embodiment in FIG. 16 contemplates a full on switch forward of the trigger guard 7. This requires two hands to operate and may not be as desirable as the preferred embodiment. Also, in accordance with certain regulations this embodiment may require a green light facing the shooter indicating when the laser is on or off.

Figure 15:
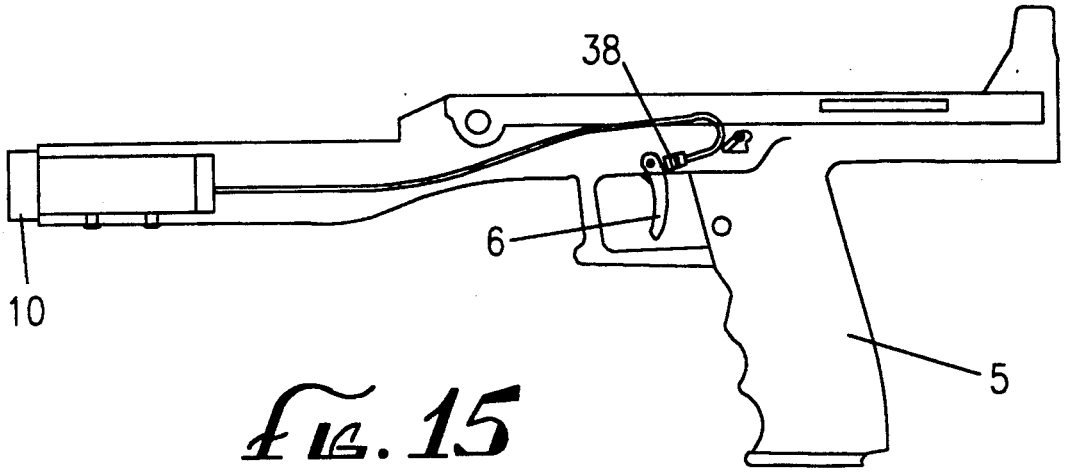

FIG. 15 illustrates a third embodiment contemplated herein. This is a trigger-activated switch which is operated by a spring 38 under the front spur of the trigger 6. When the trigger 6 is pulled slightly to the rear, the spur of the trigger 6 makes contact with the spring switch depressing it during the firing cycle.

Thus, a position of a laser sight for a gun and a switch to operate the laser have been disclosed. While specific embodiments and applications of this invention have been shown and described, it would be apparent to those skilled in the art that many more modifications are possible without departing from the inventive concepts herein. The invention, therefore, is not to be restricted except in the spirit of the appended claims.

What is claimed is:

1. A hand held gun having a chamber and barrel assembly capable of shooting projectiles comprised of the following:

(a) a one piece integrally cast housing having a pistol grip, a rear and front portion adjacent a trigger guard and an upward facing receiving portion for receiving the chamber and barrel assembly;

(b) said receiving portion of said housing extending substantially rearwardly of said pistol grip and having a socket for receiving a rear portion of said chamber and barrel assembly;

(c) said housing also adjoining a trigger;

(d) said housing having an integrally cast laser enclosure positioned forward of said trigger guard and pistol grip and below said chamber and barrel assembly;

(e) a self-contained laser and power source enclosed within said laser enclosure;

(f) means for selectively activating the laser including a switch means located on the rear of the pistol grip.

2. A composite firearm comprising (a) a hand grip, an adjoining trigger, and an integrally formed enclosure for a self-contained laser assembly wherein said laser assembly comprises a laser sight, a battery, a contact, and a threaded cap;

(b) a pressure-activated switch protruding from the back of said grip to activate said laser assembly;

(c) a means for electrically connecting said switch and said laser assembly;

(d) a substantially cylindrical receiving cavity disposed above said grip for snugly receiving a barrel assembly wherein said cavity receives said barrel assembly such that said barrel assembly runs parallel to and immediately adjacent a chamber housing said laser assembly said cylindrical cavity comprising a socket wherein said socket is disposed at a most rearward portion of said cylindrical cavity.

* * * * *